US008956429B2

(12) United States Patent
Lee et al.

(10) Patent No.: US 8,956,429 B2
(45) Date of Patent: Feb. 17, 2015

(54) COMPOSITION FOR CUTTING WHEEL AND CUTTING WHEEL BY USING THE SAME

(75) Inventors: Doo-Hyun Lee, Seoul (KR); Baek-Nam Noh, Seoul (KR); Soo-Won Lee, Seoul (KR)

(73) Assignee: 3M Innovative Properties Company, St. Paul, MN (US)

( * ) Notice: Subject to any disclaimer, the term of this patent is extended or adjusted under 35 U.S.C. 154(b) by 232 days.

(21) Appl. No.: 13/386,527

(22) PCT Filed: Aug. 25, 2010

(86) PCT No.: PCT/US2010/046581

§ 371 (c)(1),
(2), (4) Date: Jan. 23, 2012

(87) PCT Pub. No.: WO2011/028561

PCT Pub. Date: Mar. 10, 2011

(65) Prior Publication Data

US 2012/0149289 A1 Jun. 14, 2012

(30) Foreign Application Priority Data

Sep. 2, 2009 (KR) ..... 10-2009-0082535

(51) Int. Cl.

| | |
|---|---|
| ***B24D 3/28*** | (2006.01) |
| ***B24D 18/00*** | (2006.01) |
| ***B24D 5/12*** | (2006.01) |
| ***B24D 3/30*** | (2006.01) |
| ***B24D 3/34*** | (2006.01) |

(52) U.S. Cl.

CPC *B24D 3/30* (2013.01); *B24D 3/346* (2013.01); *B24D 5/12* (2013.01)

USPC ..... 51/298

(58) Field of Classification Search

USPC ..... 51/293, 298; 451/546

See application file for complete search history.

(56) References Cited

U.S. PATENT DOCUMENTS

| | | | | | |
|---|---|---|---|---|---|
| 2,814,918 | A | | 12/1957 | Erickson | |
| 3,718,447 | A | * | 2/1973 | Hibbs et al. | 51/295 |
| 3,838,543 | A | | 10/1974 | Lakhani | |
| 4,259,089 | A | * | 3/1981 | Waizer et al. | 51/295 |
| 5,167,674 | A | | 12/1992 | Ika | |
| 5,368,619 | A | * | 11/1994 | Culler | 51/308 |
| 5,472,461 | A | * | 12/1995 | Li | 51/296 |
| 5,500,273 | A | | 3/1996 | Holmes | |
| 5,549,962 | A | | 8/1996 | Holmes | |
| 5,695,394 | A | * | 12/1997 | Buffat et al. | 451/546 |
| 5,876,470 | A | | 3/1999 | Abrahamson | |
| 6,394,888 | B1 | | 5/2002 | Matsumot | |
| 6,593,391 | B2 | * | 7/2003 | Teutsch et al. | 522/81 |
| 2004/0088926 | A1 | | 5/2004 | Kinisky | |

FOREIGN PATENT DOCUMENTS

| | | |
|---|---|---|
| CN | 101134299 | 3/2008 |
| JP | 60-184523 | 9/1985 |
| WO | WO 03/045634 A1 | 6/2003 |

* cited by examiner

*Primary Examiner* — Pegah Parvini
(74) *Attorney, Agent, or Firm* — Scott A. Baum

(57) ABSTRACT

Disclosed are a cutting wheel composition, and a cutting wheel using the cutting wheel composition. The disclosed composition includes 50 to 85 wt % of abrasive particles, 10 to 25 wt % of binder resin, and balance filler, wherein the binder resin includes a phenolic resin as a first binder resin; and at least one of a (bis)maleimide resin and a cyanate ester resin as a second binder resin. The composition includes at least one of the (bis)maleimide resin and the cyanate ester resin, as well the phenolic resin, as the binder resin, and thereby makes it possible to fabricate a cutting wheel having improved life characteristics through the improvement of heat-resistance and scratch-resistance.

15 Claims, No Drawings

COMPOSITION FOR CUTTING WHEEL AND CUTTING WHEEL BY USING THE SAME

CROSS REFERENCE TO RELATED APPLICATIONS

This application is a national stage filing under 35 U.S.C. §371 of PCT/US10/46581, filed Aug. 25, 2010, which claims priority to Korean Application No. 10-2009-0082535, filed Sep. 2, 2009, the disclosures of which are incorporated by reference in their entirety herein.

BACKGROUND OF THE INVENTION

The present invention relates to a cutting wheel composition, and a cutting wheel including the same.

A cutting wheel is used for cutting various types of base materials made of metals, plastics, or the like. In general, the cutting wheel is fabricated by pouring a composition including abrasive particles, a binder resin, and filler, into a disk-shaped mold, and compressing the composition at a predetermined pressure, followed by curing. Herein, as the binder resin, a phenolic resin, which is known as a heat-resistant resin with a glass transition temperature ($T_g$) of about 200° C., and a heat decomposition temperature of about 300° C., has been mainly used.

When a base material is cut by using such a cutting wheel, the friction between the cutting wheel and the base material generates heat, thereby increasing the temperature at the cutting area. This causes thermal damage to the cutting wheel.

Such thermal damage to the cutting wheel is one of the main causes of limitation of a cutting operation. Therefore, a research on the friction heat caused by the use of the cutting wheel has recently been actively conducted. In 2004, S. Malkin researched the heat caused by friction between a cutting wheel and a base material during a cutting operation. According to the result of the research, when the cutting wheel is used to cut the base material, the friction between the cutting wheel and the base material generates a friction heat, thereby highly increasing the temperature of a cutting area, that is, the interface temperature between the cutting wheel and the base material, up to about 600° C.

Accordingly, even though a heat-resistant resin (such as a phenolic resin) is used as a binder resin, a high friction heat generated at the cutting area heat-decomposes (thermally deforms) the phenolic resin existing on the cutting wheel portion corresponding to the cutting area, thereby separating abrasive particles bound by the phenolic resin from the cutting wheel. Such separation of the abrasive particles repeatedly occurs whenever the cutting wheel is used, and thus the life of the cutting wheel is reduced.

Therefore, it is required to develop a novel cutting wheel composition with high heat-resistance in order to inhibit the occurrence of thermal damage when a cutting wheel is used for cutting a base material.

SUMMARY OF THE INVENTION

The inventors of the present invention have found that when a (bis)maleimide resin and/or a cyanate ester resin as well as a phenolic resin are used as a binder resin for a cutting wheel composition, it is possible to fabricate a cutting wheel having improved life characteristics by the improvement of heat-resistance and scratch-resistance.

Accordingly, in the present invention, as a binder resin, a (bis)maleimide resin and/or a cyanate ester resin as well as a phenolic resin are used. Such a binder resin more firmly bind abrasive particles within a cutting wheel, thereby improving the heat-resistance and scratch-resistance, and life characteristics of the cutting wheel.

In accordance with an aspect of the present invention, there is provided a cutting wheel composition, and a cutting wheel using the cutting wheel composition, the composition including 50 to 85 wt % of abrasive particles, 10 to 25 wt % of binder resin, and balance filler, wherein the binder resin includes a phenolic resin as a first binder resin; and at least one of a (bis)maleimide resin and a cyanate ester resin as a second binder resin.

The cutting wheel composition of the present invention includes at least one of a (bis)maleimide resin and a cyanate ester resin, together with a phenolic resin, thereby making it possible to fabricate a cutting wheel with improved life characteristics through the improvement of heat-resistance and scratch-resistance.

DETAILED DESCRIPTION OF THE EXEMPLARY EMBODIMENTS

Hereinafter, the present invention will be described in detail.

In the present invention, the meaning of cutting includes abrasion, cutting-off, and cutting.

The present invention relates to a cutting wheel composition including abrasive particles, a binder resin, and filler, and is characterized in that in using a cutting wheel, in order to prevent the abrasive particles separating from the cutting wheel by thermal deformation of the binder resin due to high friction heat generated at the cutting area, a (bis)maleimide resin and/or a cyanate ester resin as well as a phenolic resin are used as the binder resin, and their contents are adjusted to more firmly bind the abrasive particles.

Specifically, when a phenolic resin, and a (bis)maleimide resin (and/or a cyanate ester resin) are used as the binder resin of the present invention, —OH position of the phenolic resin and a C—C double bonding site of the (bis)maleimide resin (and/or —CN position of the cyanate ester resin) react with each other during thermosetting, thereby forming dense network structures. The binder resin, which is subjected to thermosetting, has high strength and high heat-resistance, compared to a conventional binder resin using only a phenolic resin. Thus, even if a high friction heat is generated at the cutting area, it is possible to firmly bind abrasive particles. This may improve the heat-resistance and scratch-resistance of a cutting wheel using the cutting wheel composition of the present invention.

In the present invention, a phenolic resin used as a first binder resin is a resin prepared by condensation polymerization of phenols and formaldehydes, and has a cross-linked network structure by thermosetting. The phenolic resin used for the present invention may have various forms, such as liquid and/or powder, without particular limitation. The examples of such a phenolic resin include a resole-type phenolic resin, a novolac-type phenolic resin, etc.

In the present invention, in order to improve the heat-resistance and scratch-resistance of the cutting wheel, at least one of a (bis)maleimide resin and a cyanate ester resin is mixed with the above mentioned phenolic resin for use as a binder resin.

The (bis)maleimide resin used for the present invention may form a cross-linked structure by thermosetting. Specifically, the (bis)maleimide resin has a cross-linked network structure by reacting a C—C double bonding of the (bis) maleimide group with a C—C double bonding of another (bis)maleimide group through thermosetting, and thus has high heat-resistance and high strength. When such a (bis) maleimide resin is used as a second binder resin, it is possible to achieve a more dense network structure by reacting with a phenolic resin as a first binder resin through thermosetting. Due to such a network cross-linked structure, the binder resin of the present invention can be more thermally stable enough to resist the friction heat generated by cutting. Accordingly, since the binder resin of the present invention, compared to a conventional binder resin using only a phenolic resin, is less thermally decomposed by a friction heat generated by cutting, it is possible to more firmly bind abrasive particles and/or filler.

Non-limiting examples of the (bis)maleimide resin include bis(3-ethyl-5-methyl-4-maleimide-phenyl) methane resin, N-phenyl maleimide, bis(maleimide-triazine) addition copolymer, N,N'-phenylenebismaleimide, N,N'-hexamethylenebismaleimide, N,N'-benzophenonebismaleimide, N,N'-diphenylmethanebismaleimide, N,N'-oxy-di-p-phenylenebismaleimide, N,N'-4,4'-benzophenonebismaleimide, N,N'-p-diphenylsulfonebismaleimide, N,N'-(3,3'-dimethyl) methylene-di-p-phenylenebismaleimide, poly (phenylmethylene)polymaleimide, 2,2'-bis(4-phenoxyphenyl)propane-N,N'-bismaleimide, bis(4-phenoxyphenyl)sulfone-N,N'-bismaleimide, 1,4-bis(4-phenoxy)benzene-N,N'-bismaleimide, 1,3-bis(4-phenoxyphenyl)sulfone-N,N'-bismaleimide, 1,3-bis-(3-phenoxy)benzene-N,N'-bismaleimide, etc. and the (bis) maleimide resins may be used alone or in combination.

Also, the (bis)maleimide resin has a decomposition temperature (TGA) ranging from 300 to 380° C., and a glass transition temperature ranging from about 305 to 325° C. after cross-linking. Thus, the (bis)maleimide resin can resist the friction heat generated by the cutting of a cutting wheel, thereby inhibiting abrasive particles from separating from the cutting wheel.

Meanwhile, in the present invention, besides the above mentioned (bis)maleimide resin, a cyanate ester resin may be used as a second binder resin. Also, a mixture of the (bis) maleimide resin with the cyanate ester resin may be used as a second binder resin.

The cyanate ester resin, which has monomers containing at least one cyanate ester functional group (—O—C≡N), has a triazine group cross-linked network structure due to the initiation of a cyclotrimerization reaction by heat, and thereby has high heat-resistance and high strength. When such a cyanate ester resin is used as a second binder resin, it is possible to achieve a more dense network structure by reacting with a phenolic resin as a first binder resin through thermosetting. Due to such a network cross-linked structure, the binder resin of the present invention can resist friction heat generated by cutting, and thus can firmly bind abrasive particles and/or filler.

Non-limiting examples of the cyanate ester resin include oligo(3-methylene-1,5-phenylenecyanate) (or Formaldehyde, polymer with phenol, cyanate), prepolymer bisphenol A dicyanate oligomer, 2,2-Bis(4-cyanatophenyl)propane homopolymer, 2,2-bis(4-cyanatophenyl)propane, polycesol cyanate, polyphenolcyanate, 4,4'-ethylidenediphenyl dicyanate, 4,4'-methylenebis(2,6-dimethylphenyl cyanate), etc., and the cyanate ester resins may be used alone or in combination.

Also, the cyanate ester resin has a decomposition temperature (TGA) ranging from about 400 to 420° C., and a glass transition temperature ranging from about 390 to 410° C. during cross-linking. Thus, the cyanate ester resin can resist friction heat generated by the cutting of a cutting wheel, thereby inhibiting abrasive particles from separating from the cutting wheel.

The cutting wheel composition of the present invention may include a phenolic resin as a first binder resin, and a (bis)maleimide resin and/or a cyanate ester resin as a second binder resin in varying ratios. However, the cutting wheel composition of the present invention preferably includes the first binder resin (a) and the second binder resin (b) in a weight ratio of 60~80:40~20 in such a manner that the heat-resistance or scratch-resistance of the cutting wheel cannot be reduced. According to an embodiment of the present invention, the phenolic resin and the (bis)maleimide resin are mixed in a weight ratio of 70:30, and the phenolic resin and the cyanate ester resin are mixed in a weight ratio of 70:30.

The binder resin of the present invention, which includes the first and second binder resins in the above mentioned ratio, is preferably included in an amount of 10 to 25 percent by weight with respect to the total weight of the cutting wheel composition, so as to prevent abrasive particles from separating from the cutting wheel when the cutting wheel is used. This inhibits the reduction of the life of the cutting wheel, thereby allowing the cutting wheel to effectively cut a base material.

The cutting wheel composition of the present invention, besides the above mentioned binder resin, includes abrasive particles providing a cutting function to the cutting wheel. The kind of the abrasive particles is not particularly limited, as long as they are known in the art.

Examples of such abrasive particles include metallic abrasive particles, metal-coated abrasive particles, inorganic abrasive particles, mineral abrasive particles, ceramic abrasive particles, etc., and appropriate abrasive particles may be selected according to the characteristic of a to-be-abraded object by a person skilled in the art. Non-limiting examples of the abrasive particles include aluminum oxide, ceramic aluminum oxide, heat-treated aluminum oxide, silica, silicon carbide, fused aluminum oxide (e.g. fused alumina-zirconia), sol-gel-induced ceramic aluminum oxide, titanium diboride, boron carbide, cubic boron nitride, etc., and the abrasive particles may be used alone or in combination. The sol-gel-induced ceramic aluminum oxide may be treated or not treated with a seed layer.

The average particle diameter of the abrasive particles is not particularly limited, but is preferably within a range of about 0.1 to 1500 μm, about 10 to 1000 μm, or about 180 to 800 μm. According to an embodiment of the present invention, the average particle diameter of the abrasive particles may be within a range of about 500 to 700 μm in accordance with ANSI Grades 36 and 24.

Also, the hardness of the abrasive particles is not particularly limited as long as the hardness is higher than that of the base material to be cut, cut-off or abraded. Preferably, the abrasive particles have a Knoop hardness of more than about 15 $kN/mm^2$.

Also, although there is no particular limitation on the shape of the abrasive particles, the abrasive particles may have an irregular form or may be formed into a predetermined shape. For example, before final abrasive particles are formed through the sintering of initial particles, the initial particles may be ground or may be formed into a pillar-shape, a pyramid-shape, or a polygonal shape.

Such abrasive particles may include one kind of abrasive particles, or an abrasive aggregate formed by adhesion of two or more kinds of abrasive particles.

In the cutting wheel composition of the present invention, the abrasive particles are preferably included in an amount of about 50 to 85 percent by weight with respect to the total weight so that the cutting wheel can effectively cut a base material.

The cutting wheel composition of the present invention, besides the above mentioned binder resin and abrasive particles, includes filler which can occupy predetermined spaces and/or provide porosity. Accordingly, in using a final cutting wheel to cut a base material, when the cutting wheel is worn, in other words, abrasive particles are worn, new abrasive particles may be exposed. Also, the filler may function as an abrasive adjuvant capable of improving the cutting property of the cutting wheel by reducing the temperature of the interface to be cut by the cutting wheel.

Examples of the filler include calcite, marl, marble, limestone, metal carbonates, (such as calcium carbonate, calcium magnesium carbonate, sodium carbonate, magnesium carbonate), silicas (such as amorphous silica, quartz, glass beads, glass bubbles), silicates (such as talc, clays, mica, calcium silicate, calcium metasilicate, sodium aluminosilicate, sodium silicate), metal sulfates (such as calcium sulfate, sodium sulfate, aluminum sulfate, aluminum sodium sulfate), gypsum, vermiculite, aluminum trihydrate, metal oxides (such as calcium oxide, aluminum oxide, titanium dioxide), metal sulfites (such as calcium sulfite) or the like. The filler may be used alone or in combination in such a manner that the porosity of the cutting wheel can be within a range of about 1 to 50 volume percent, or about 1 to 40 volume percent. In addition, sodium chloride, magnesium chloride, cryolite, $FeS_2$ or the like may be used alone or in combination so as to reduce the temperature of the cutting interface.

The particle diameter of the filler may vary according to the kind of the filler. However, when the particle diameter is too small, the surface area of the filler, after the mixing, is very large so that the binder resin cannot sufficiently fix the filler, and on the other hand, when the particle diameter is too large, the filler may not properly perform its own function. Thus, it is preferable that the filler has a particle diameter within a range of about 30 to 100 μm.

Such filler preferably constitutes the rest of the total weight of the cutting wheel composition, so that the cutting wheel can effectively cut a base material while not causing its flexure.

Meanwhile, the cutting wheel composition of the present invention, in addition to the binder resin, abrasive particles, and filler, may further include a coupling agent and/or a metal short fiber.

The coupling agent used for the present invention has, in its molecule, both of a hydrophobic functional group capable of binding a binder resin and a hydrophilic functional group capable of binding abrasive particles, and thus can improve life characteristics as well as the strength of the cutting wheel by more firmly maintaining the bindings between the binder resin and the abrasive particles, and/or the filler.

Examples of such a coupling agent include, but not limited thereto, a silane-based coupling agent, a titanate-based coupling agent, a zirconate-based coupling agent, a zircoaluminate-based coupling agent, or the like.

More specifically, examples of the coupling agent, include, but not limited thereto: silane coupling agents, such as monoalkoxysilane, dialkoxysilane, trialkoxysilane, dipodalalkoxysilane; titanate coupling agents, such as monoalkoxy type, chelate type, coordinate type; zirconate coupling agents, such as monoalkoxyzirconium, trialkoxyzirconium; zircoaluminate coupling agents, such as monoalkoxy zircoaluminate, trialkoxy zircoaluminate. According to one embodiment of the present invention, as a coupling agent, Gamma-Aminopropyl triethoxysilane (that is, a saline coupling agent) was used.

Such a kind of coupling agent is preferably included in an amount of about 0.1 to 0.3 percent by weight with respect to the total weight of the composition so that the binder resin and the abrasive particles, and/or the filler can be more firmly bound.

Also, metal short fiber that may be used in the present invention has high thermal conductivity, and performs a role of preventing a base material from discoloring, when cut by the cutting wheel. Specifically, in cutting the base material by the cutting wheel, friction heat of less than about 600° C., which is generated by the spin of the cutting wheel, burns the base material, while the metal short fiber of the cutting wheel prevents the discoloration of the base material by abrading and removing the black-burned portion of the base material.

Non-limiting examples of such metal short fiber include aluminum short fiber, nickel short fiber, zinc short fiber, stainless steel short fiber, titanium short fiber, copper short fiber, and an alloy thereof, and the metal short fibers may be used alone or in combination.

There is no particular limitation on the diameter and length of the metal short fiber. However, preferably, the metal short fiber has a diameter of about 10 to 20 μm, and a length of less than about 1 mm so as to prevent the base material from discoloring when it is cut by the cutting wheel.

Preferably, such metal short fiber is included in an amount of about 3 to 6 percent by weight with respect to the total weight of the composition so as to prevent the base material from discoloring when it is cut by the cutting wheel.

Also, the cutting wheel composition of the present invention, in addition to the above mentioned components, may further include other additives, such as a lubricant. The lubricant is a friction-wear adjusting agent, which performs the role of adjusting the coefficient of friction in the cutting wheel, and there is no particular limitation on the lubricant as long as it is conventionally used in the art. Preferably, the lubricant is a solid lubricant, such as graphite, molybdenum disulphide, antimony trisulphide. Such a lubricant is preferably included in an amount of about 0.05 to 0.2 percent by weight with respect to the total weight of the composition.

The cutting wheel composition of the present invention may be prepared by a conventional method known in the art.

For example, the cutting wheel composition of the present invention may be prepared by the steps of: adding abrasive particles in a binder resin in a liquid state to form a wet mixture of the binder resin and the abrasive particles; mixing filler and other additives with a binder resin in a solid state to form a powder mixture of the binder resin and the filler; and mixing the wet mixture with the powder mixture, but is not limited thereto.

Meanwhile, the present invention provides a cutting wheel fabricated by using the above described cutting wheel composition. The cutting wheel is fabricated by a conventional method known in the art, e.g. a compression molding process, an injection molding process, a transfer molding process, or the like. Such a process may include hot pressing or cold pressing, but is not limited thereto.

Hereinafter, the present invention will be described in detail with reference to Examples and Experimental Examples. However, the following examples are illustrative only, and the scope of the present invention is not limited thereto.

Example 1

1-1. Preparation of a Cutting Wheel Composition 36 wt % of Ceramic coated Blown Aluminum Oxide (BZESCC F30, Tribacher Schleifmittel) and 36 wt % of nonseeded alpha aluminum oxide (321 Cubitron™ Abrasive Grain WG 30, 3M USA), as abrasive particles, were mixed with 3.7 wt % of resole type phenolic resin(liquid) (Phenolite TD-2207, Kangnam Chemical Co.) as a binder resin for 5 minutes to provide a wet mixture of the binder resin and the abrasive particles.

Meanwhile, 5.2 wt % of novolac type phenolic resin(solid) (Phenolite TD-739, Kangnam Chemical Co.) and 3.8 wt % of bis(3-ethyl-5-methyl-4-maleimide-phenyl)methane (solid) (BMI-70, KI Chemical Industry Co.), as a binder resin were mixed with 10 wt % of Sodium hexafluoroaluminate (Synthetic Cryolite, MetaChem Co.), 5 wt % of aluminum short fiber (Aluminum Fiber, Future Metal Co.), 0.2 wt % of silane coupling agent (Z-6011, Dow Corning), and 0.1 wt % of graphite (HC-598, Hyundai Coma Co.), as additives, for 5 minutes to provide a powder mixture of the binder resin and the additives.

Then, the wet mixture and the powder mixture were mixed in a cement mixer for about 10 minutes to provide a cutting wheel composition.

1-2. Fabrication of a Cutting Wheel

The cutting wheel composition obtained as above was put in a disc-shaped mold, was compressed under the pressure of 100 kg/cm$^2$, and then cured in a hot-air oven for 24 hours at about 250° C. to provide a cutting wheel (external diameter: 405 mm, internal diameter: 25.4 mm, thickness: 4 mm).

Example 2

A cutting wheel composition and a cutting wheel were obtained in the same manner as described in Example 1, except that instead of 3.8 wt % of bis(3-ethyl-5-methyl-4-maleimide-phenyl)methane (solid) (BMI-70, KI Chemical Industry Co.), 3.8 wt % of oligo(3-methylene-1,5-phenylenecyanate) (Primaset PT-60, Lonza Inc.) was used.

Comparative Example 1

72 wt % of brown aluminum oxide P 30 (FEPA P 30 grade, Zheng Zhou Abrasives Factory, China) was mixed with 3.9 wt % of resole type phenolic resin(liquid)(Phenolite TD-2207, Kangnam Chemical Co.) as a binder resin for 5 minutes to provide a wet mixture of the binder resin and abrasive particles.

Meanwhile, 8 wt % of novolac type phenolic resin (solid) (Phenolite TD-739, Kangnam Chemical Co.) as a binder resin was mixed with 16 wt % of sodium hexafluoroaluminate (Synthetic Cryolite, MetaChem Co.) and 0.1 wt % of graphite (HC-598, Hyundai Coma Co.), as additives, for 5 minutes to provide a powder mixture of the binder resin and additives.

Then, the wet mixture and the powder mixture were mixed in a cement mixer for about 10 minutes to provide a cutting wheel composition.

The cutting wheel composition obtained as above was put in a disc-shaped mold, was compressed under the pressure of 100 kg/cm$^2$, and then cured in a hot-air oven for 24 hours at about 250° C. to provide a cutting wheel (external diameter: 405 mm, internal diameter: 25.4 mm, thickness: 4 mm).

Comparative Example 2

A cutting wheel composition and a cutting wheel were obtained in the same manner as described in Example 1, except that instead of 5.2 wt % of novolac type phenolic resin(solid) (Phenolite TD-739, Kangnam Chemical Co.) and 3.8 wt % of bis(3-ethyl-5-methyl-4-maleimide-phenyl)methane (solid) (BMI-70, KI Chemical Industry Co.), 9 wt % of novolac type phenolic resin(solid) (Phenolite TD-739, Kangnam Chemical Co.) were used.

Experimental Example 1

Cutting Test

In order to test the cutting performance of the cutting wheel according to the present invention, the following cutting test was carried out.

Each of the cutting wheels obtained from Examples 1 and 2 was mounted on a cutting saw device, and each of the cutting wheels obtained from Comparative Examples 1 and 2, as a control group, was mounted on a cutting saw device. Meanwhile, three base materials, each of which is L-type 45C steel angle (carbon steel)(50 mm×50 mm×4 mm), were piled up. The cutting wheel mounted on the cutting saw device was used to cut the three base materials, and then the number of times of cutting until the external diameter of the cutting wheel reaches 230 mm was measured. Herein, the horsepower of the cutting saw was 3 HP or 5 HP (Max. rotation speed: 3850 rpm). Table 1 shows the test results.

TABLE 1

| | Horse power (HP) | Number of times of cutting |
|---|---|---|
| Example 1 | 3 | 125 |
| | 5 | 140 |
| Example 2 | 3 | 138 |
| | 5 | 155 |
| Comparative Example 1 | 3 | 33 |
| | 5 | 35 |
| Comparative Example 2 | 3 | 111 |
| | 5 | 122 |

As a result of the test, in the case of the cutting wheel obtained from Example 1, the numbers of times of cutting were 125 at 3 HP, and 140 at 5 HP, which are about 3.79 times higher and about 4 times higher, respectively, compared to the cutting wheel obtained from Comparative Example 1. Also, in the case of the cutting wheel obtained from Example 2, the numbers of times of cutting were about 4.18 times higher at 3 HP, and about 4.43 times higher at 5 HP, respectively, compared to the cutting wheel obtained from Comparative Example 1. Also, the cutting wheels obtained from Examples 1 and 2 can cut the three piled-up base materials for a longer period of time, compared to the cutting wheel obtained from Comparative Example 2.

Thus, it can be seen that the cutting wheel fabricated by using the cutting wheel composition according to the present invention has a significantly high cutting performance, compared to a conventional cutting wheel fabricated by a conventional cutting wheel composition.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cutting wheel composition comprising 50 to 85 wt % of abrasive particles, 10 to 25 wt % of binder resin, and filler, wherein the binder resin comprises a phenolic resin comprising a phenol formaldehyde resin as a first binder resin; and at least one of a (bis)maleimide resin and a cyanate ester resin as a second binder resin.

2. The cutting wheel composition as claimed in claim 1, wherein the first binder resin (a) and the second binder resin (b) are in a weight ratio within a range of (a):(b)=60~80:40~20.

3. The cutting wheel composition as claimed in claim 1, wherein the (bis)maleimide resin is selected from the group including poly(N-phenyl maleimide), bis(maleimide-triazine) addition copolymer, bis(3-ethyl-5-methyl-4-maleimidephenyl)methane resin, N,N'-phenylenebismaleimide, N,N'-hexamethylenebismaleimide, N,N'-benzophenonebismaleimide, N,N'-diphenylmethanebismaleimide, N,N'-oxy-di-p-phenylenebismaleimide, N,N'-4,4'-benzophenonebismaleimide, N,N'-p-diphenylsulfonebismaleimide, N,N'-(3,3'-dimethyl)methylene-di-p-phenylenebismaleimide, poly(phenylmethylene)polymaleimide, 2,2'-bis(4-phenoxyphenyl)propane-N,N'-bismaleimide, bis(4-phenoxyphenyl)sulfone-N,N'-bismaleimide, 1,4-bis(4-phenoxy)benzene-N,N'-bismaleimide, 1,3-bis(4-phenoxyphenyl)sulfone-N,N'-bismaleimide, and 1,3-bis-(3-phenoxy)benzene-N,N'-bismaleimide.

4. The cutting wheel composition as claimed in claim 1, wherein the cyanate ester resin is selected from the group including oligo(3-methylene-1,5-phenylenecyanate), prepolymer bisphenol A dicyanate oligomer, 2,2-bis(4-cyanatophenyl)propane homopolymer, 2,2-bis(4-cyanatophenyl)propane, polycresol cyanate, polyphenolcyanate, 4,4'-ethylidenediphenyl dicyanate, and 4,4'-methylenebis(2,6-dimethylphenyl cyanate).

5. The cutting wheel composition as claimed in claim 1, further comprising both or one of a metal short fiber, wherein the metal short fiber has a length of less than about 1 mm, and a coupling agent.

6. The cutting wheel composition as claimed in claim 5, wherein the metal short fiber is selected from the group including aluminum short fiber, nickel short fiber, zinc short fiber, stainless steel short fiber, titanium short fiber, copper short fiber, alloy short fiber thereof, and a mixture thereof.

7. The cutting wheel composition as claimed in claim 5, wherein the coupling agent is selected from the group including a silane-based coupling agent, a titanate-based coupling agent, a zirconate-based coupling agent, and a zircoaluminate-based coupling agent.

8. A cutting wheel fabricated by molding the cutting wheel composition of claim 1 in the shape of a cutting wheel and curing the molded cutting wheel composition.

9. The cutting wheel composition of claim 1 wherein the phenolic resin comprises either a resole-type phenolic resin or a novolac-type phenolic resin.

10. A cutting wheel composition comprising 50 to 85 wt % of abrasive particles, 10 to 25 wt % of binder resin, and filler, wherein the binder resin comprises a phenolic resin as a first binder resin; and at least one of a (bis)maleimide resin and a cyanate ester resin as a second binder resin; and wherein the first binder resin (a) and the second binder resin (b) are in a weight ratio within a range of (a):(b)=60~80:40~20.

11. The cutting wheel composition as claimed in claim 10, wherein the (bis)maleimide resin is selected from the group including poly(N-phenyl maleimide), bis(maleimide-triazine) addition copolymer, bis(3-ethyl-5-methyl-4-maleimidephenyl)methane resin, N,N'-phenylenebismaleimide, N,N'-hexamethylenebismaleimide, N,N'-benzophenonebismaleimide, N,N'-diphenylmethanebismaleimide, N,N'-oxy-di-p-phenylenebismaleimide, N,N'-4,4'-benzophenonebismaleimide, N,N'-p-diphenylsulfonebismaleimide, N,N'-(3,3'-dimethyl)methylene-di-p-phenylenebismaleimide, poly(phenylmethylene)polymaleimide, 2,2'-bis(4-phenoxyphenyl)propane-N,N'-bismaleimide, bis(4-phenoxyphenyl)sulfone-N,N'-bismaleimide, 1,4-bis(4-phenoxy)benzene-N,N'-bismaleimide, 1,3-bis(4-phenoxyphenyl)sulfone-N,N'-bismaleimide, and 1,3-bis-(3-phenoxy)benzene-N,N'-bismaleimide.

12. The cutting wheel composition as claimed in claim 10, wherein the cyanate ester resin is selected from the group including oligo(3-methylene-1,5-phenylenecyanate), prepolymer bisphenol A dicyanate oligomer, 2,2-bis(4-cyanatophenyl)propane homopolymer, 2,2-bis(4-cyanatophenyl)propane, polycresol cyanate, polyphenolcyanate, 4,4'-ethylidenediphenyl dicyanate, and 4,4'-methylenebis(2,6-dimethylphenyl cyanate).

13. A cutting wheel composition comprising 50 to 85 wt % of abrasive particles, 10 to 25 wt % of binder resin, and filler, wherein the binder resin comprises a phenolic resin as a first binder resin; and at least one of a (bis)maleimide resin and a cyanate ester resin as a second binder resin; and further comprising both or one of a metal short fiber, wherein the metal short fiber has a length of less than about 1 mm, and a coupling agent.

14. The cutting wheel composition as claimed in claim 13, wherein the metal short fiber is selected from the group including aluminum short fiber, nickel short fiber, zinc short fiber, stainless steel short fiber, titanium short fiber, copper short fiber, alloy short fiber thereof, and a mixture thereof.

15. The cutting wheel composition as claimed in claim 13, wherein the coupling agent is selected from the group including a silane-based coupling agent, a titanate-based coupling agent, a zirconate-based coupling agent, and a zircoaluminate-based coupling agent.

* * * * *